United States Patent [19]

Johnson

[11] Patent Number: 4,738,230

[45] Date of Patent: Apr. 19, 1988

[54] VARIABLE COMPRESSION RATIO CONTROL

[76] Inventor: Kenneth A. Johnson, 15236 Tacoma St., Detroit, Mich. 48205

[21] Appl. No.: 841,379

[22] Filed: Mar. 13, 1986

[51] Int. Cl.[4] ..... F02B 75/24; F02B 75/04

[52] U.S. Cl. ..... 123/56 BC; 123/48 B; 123/78 F

[58] Field of Search ..... 123/48 R, 48 B, 78 R, 123/78 E, 78 F, 56 C, 56 BC

[56] References Cited

U.S. PATENT DOCUMENTS

| | | | |
|---|---|---|---|
| 1,174,459 | 3/1916 | Winckler | 123/48 B |
| 1,553,009 | 9/1925 | Stuke | 123/78 F |
| 2,433,639 | 12/1947 | Woodruff et al. | 123/48 B |
| 2,589,958 | 3/1952 | Petit | 123/48 B |
| 3,633,552 | 1/1972 | Huber | 123/48 B |
| 4,026,252 | 5/1977 | Wrin | 123/56 BC |

*Primary Examiner*—Craig R. Feinberg
*Assistant Examiner*—M. Macy
*Attorney, Agent, or Firm*—Peter A. Taucher; John E. McRae

[57] ABSTRACT

In an internal combustion engine, an improved mechanism for adjusting the rotational axis of the crankshaft to vary the engine compression ratio. The crankshaft is supported at spaced points therealong in circular disks that are swivably adjustable about their central axes. The crankshaft rotational axis is eccentric to the disk axis, whereby disk adjustment moves the crankshaft axis in a direction to vary the engine compression ratio.

9 Claims, 2 Drawing Sheets

VARIABLE COMPRESSION RATIO CONTROL

GOVERNMENT INTEREST

The invention described herein may be manufactured, used, and licensed by or for the Government for governmental purposes without payment to me of any royalty.

BACKGROUND AND SUMMARY OF THE INVENTION

This invention relates to mechanism for varying the compression ratio of four cycle engines. The mechanism is designed to adjust the position of the engine crankshaft rotational axis toward or away from the combustion chamber, to thereby vary the clearance volumes when the pistons are in their top dead center positions.

U.S. Pat. No. 2,433,639 to Woodruff et al and U.S. Pat. No. 2,589,958 to Petit disclose engines wherein the main bearings for the crankshaft are carried on cradle structures that can be swung around pivot mechanisms spaced laterally from the crankshaft bearings. The present invention is an improvement on the constructions disclosed in those patents.

General objects of the invention are to provide a crankshaft-adjusting mechanism wherein:

1. The output shaft centerline is fixed. There is no need for a universal joint between the engine output shaft and the associated transmission.
2. The mechanism achieves a speed change (between the engine drive shaft and transmission input).
3. The mechanism operates without reliance on elongated lever arms subject to distortion or breakage under high load forces imposed on/by the crankshaft.
4. The mechanism includes a stroke reduction connection between the adjustment power means and crankshaft support element, whereby small incremental changes in crankshaft position can be realized.
5. The mechanism is controllable electrically via electronic signals generated by microprocessor equipment already used to program engine operations.
6. The mechanism can be incorporated into existing engine designs with relatively minor changes in engine construction.
7. The mechanism does not appreciably increase the overall size of the engine.
8. The mechanism is relatively inexpensive.

THE DRAWINGS

Figure 1:
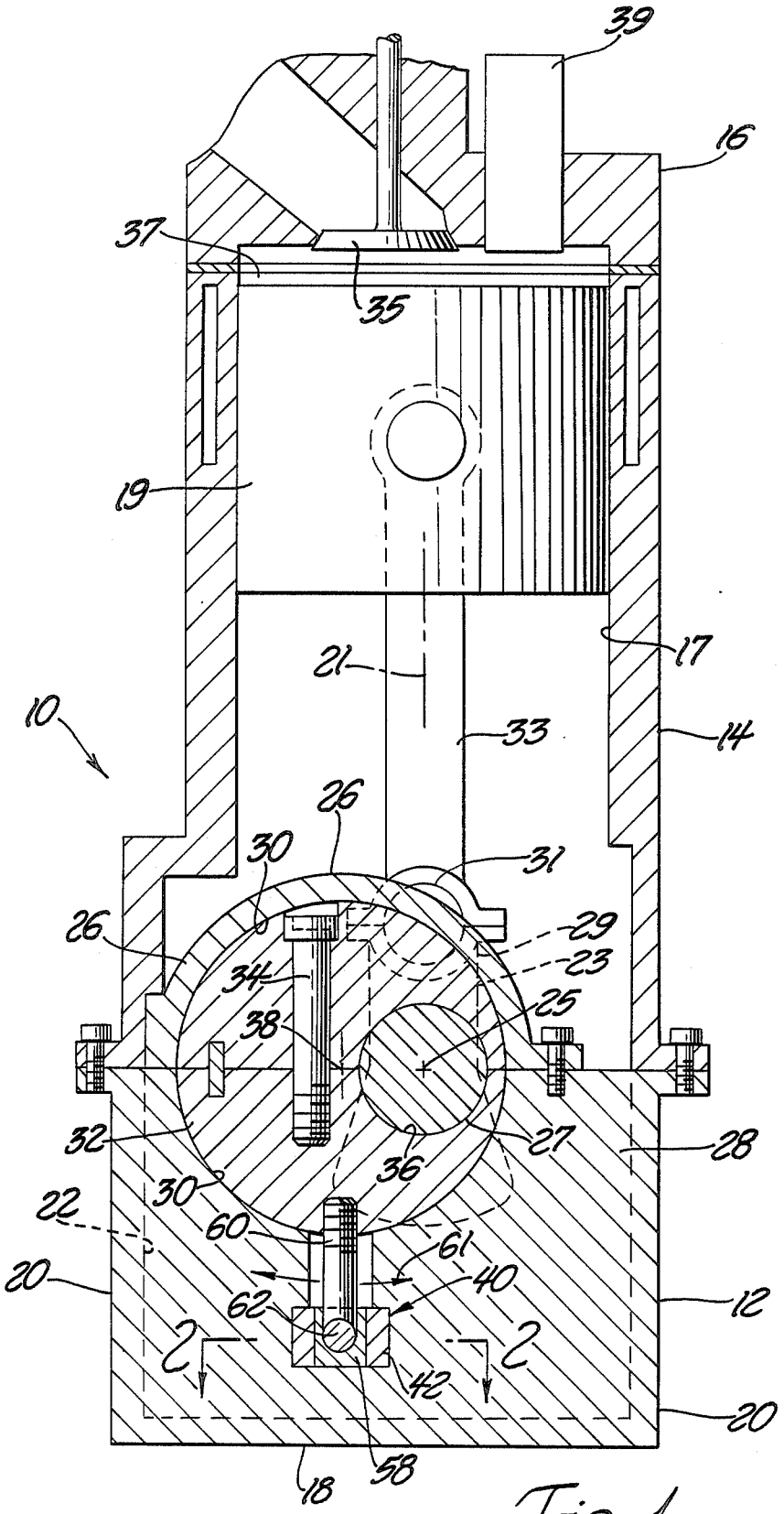
FIG. 1 is a sectional view taken through an engine that incorporates the invention therein. The engine is shown with the illustrated piston in its top dead center position.

Referring in greater detail to FIG. 1, there is shown an in-line engine 10 that comprises a crankcase 12, cylinder block 14, and cylinder head 16. Block 14 defines a plural number of combustion cylinders, one of which is shown at 17. A movable piston 19 is slidable in each cylinder for movement along cylinder axis 21.

A conventional crankshaft 23 is supported within the engine for rotation around an axis designated by numeral 25. The crankshaft includes two or more circular main shaft sections, one of which is shown at 27; the crankshaft also includes a plural number of crank arms 29 defining orbital shaft sections 31. Each piston 19 is connected to an orbital shaft section 31 of the crankshaft via a connecting rod 33.

The combustion process may be achieved in conventional fashion. The drawing illustrates conventional valve means 35 for admitting air to the combustion chamber 37; a similar valve directly behind the illustrated valve permits exhaustion of combustion products from chamber 37. Numeral 39 is intended to generically illustrate a spark plug or fuel injector. The exact nature of component 39 is determined by the engine type, i.e., spark ignition or compression ignition.

The aforementioned crankcase 12 is a pan-like structure adapted to contain oil for engine lubrication purposes. The crankcase includes bottom wall 18, and two upstanding side walls 20. The space circumscribed by walls 18, 20, 20 defines a sump 22 that acts as an oil reservoir.

At spaced points along its length, the crankcase is provided with upstanding stationary walls (bulkheads) 28 that act as support mechanisms for the aforementioned crankshaft 23. In a typical engine, there might be three such support walls 28, one at each end of the engine and a third one at or near a midpoint along the length of the engine. The crankshaft 23 and crankcase 12 are oriented so that each of the aforementioned main shaft sections 27 is in vertical planar alignment with one of the crankcase stationary walls 28.

FIG. 1 is taken in a plane coincident with an end one of the abovementioned stationary support walls 28 (in order to show features of my invention). Therefore, the aforementioned oil sump or reservoir space 22 is not visible in FIG. 1. The oil-accommodation space is defined by the inner surfaces of walls 20, 20, 18.

Each upstanding support wall (bulkhead) 28 is formed with a circular cavity 30 therethrough, designed to swivably support a circular disk 32. For assembly reasons disk structure 32 is of split design. As shown, wall 28 includes a cap element 26 configured to partially define cavity 30. Disk 32 is comprised of two semi-circular sections rigidly secured together via one or more bolts 34.

If desired, bulkhead 28 could be formed as one integral structure with a circular hole 30 therethrough (i.e., elements 28 and 26 could be integral or elements 14 and 26 integral, or elements 28, 26, and 14 could be one integral piece, in which case the crankshaft-disk 32 assembly could be installed by sliding in from one end, as necessary.

Each disk 32 has a circular opening 36 therethrough eccentric to the disk center designated by numeral 38. Opening 36 is sized so that the defined circular surface conforms to the surface of main shaft section 27 of the crankshaft. Disk 32 therefore acts as a support bearing for the associated shaft section 27.

During normal steady state operating conditions each disk 32 has a fixed position in its associated cavity 30. The engine compression ratio may be increased by rotating the various disks 32 in counterclockwise directions around centerline 38; the engine compression ratio may be decreased by rotating the various disks 32 in clockwise directions around centerline 38.

When each disk 32 is rotated a few degrees in a counterclockwise direction, the rotational axis 25 of the crankshaft is moved a slight distance upward, i.e., toward combustion chamber 37. This action causes the associated rods 33 and pistons 19 to shift upwardly, thereby reducing the clearance volume between the piston and roof surface of the combustion chamber. The effect is to increase the engine compression ratio (maximum chamber volume versus minimum chamber volume). Similarly, when each disk 32 is rotated a few degrees in a clockwise direction the crankshaft rotational axis 25 is lowered slightly to increase the clearance volume, and thus decrease the compression ratio.

Changes in the compression ratio are intended to promote efficient engine performance or increased power development under different operating conditions; compression ratio changes are also designed to increase engine operating life. The engine compression ratio may be increased in order to achieve improved efficiency under throttled running conditions. The compression ratio may be decreased in order to reduce or eliminate knocking or detonation. In multi-fuel engines, adjustment of the compression ratio may be necessary or desirable in order to permit most efficient operation consistent with the octane rating of the fuel being used.

In the FIG. 1 engine, the mechanism for rotating the various disks 32 (to vary the compression ratio) comprises a cam-cam follower means designated generally by numeral 40. The cam takes the form of an elongated rod or bar 42 oriented parallel to disk centerline 38. The cam follower means takes the form of a shoe 58 carried on the end of an arm 60 extending from each disk 32. Assuming the engine has three disks 32, there are three arms and three shoes. The elongated rod 42 has cam surfaces 56 cooperable with each shoe 58.

Figure 2:
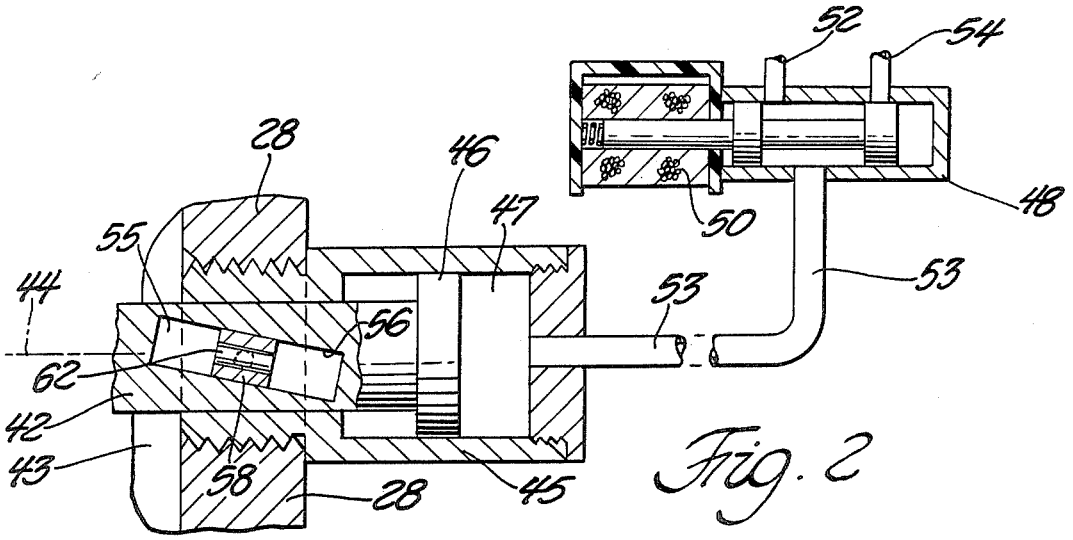
FIG. 2 is a fragmentary sectional view taken on line 2—2 in FIG. 1.

Rod 42 passes between and through the various stationary support walls 28. FIG. 2 illustrates an end portion of bar 42 extending rightwardly from engine space 43 through wall 28 to a point beyond the end of the engine; the illustrated wall 28 constitutes an end wall of the crankcase. The longitudinal axis of the bar is designated by numeral 44.

Rod 42 is mounted for longitudinal motion in the direction of its length, i.e., along axis 44. Various different types of operators can be used to produce the desired rod motion. FIG. 2 illustrates an electro-hydraulic power means that includes a small hydraulic cylinder 45 suitably attached to the end wall of the engine crankcase, and a hydraulic piston 46 suitably attached to rod 42.

Oil from the high pressure side of the engine lubrication system is admitted to chamber 47 through a shuttle valve 48 that is controlled by a solenoid operator 50. In the solenoid-energized position high pressure oil from supply line 52 passes through valve 48 into line 53, thereby pressurizing chamber 47 to move rod 42 in a leftward direction. In the solenoid-denergized position, the shuttle valve element moves right- wardly to open the hydraulic path from line 53 to drain line 54; chamber 47 is depressurized, thereby permitting rod 42 to move in a left-to- right direction.

At each point along rod 42 where it passes through a stationary support wall 28 the rod is provided with an acutely angled slot 55. The side surfaces 56 of the slot constitute a cam. The number of such cams corresponds to the number of disks 32 (FIG. 1); there is one cam slot 55 for each disk 32. In a typical engine the crankshaft would be supported at three points along the length of the engine; in such case there would be three support disks 32 and three cam slots 55.

Cooperating with each cam slot 55 is a cam. In FIGS. 1 and 2 the cam takes the form of shoe 58 carried on an end portion of arm 60 (FIG. 1) that extends from disk 32. The connection between arm 60 and shoe 58 is preferably such as to permit a slight rocking motion as arm 60 swings in the arrow 61 direction (FIG. 1). The rocking action can be achieved by providing a short transverse shaft 62 on the outer end of arm 60; shoe 58 is swivably carried on the transverse shaft.

The operation of rod 42 is such that pressurization or depressurization of cylinder 45 (FIG. 2) causes the rod to move in the direction of its axis. The angulation of each cam slot 55 is such that the associated shoe 58 is shifted in a plane normal to rod axis 44. Shoe 58 movement produces arcuate motion of arm 60 and the associated disk 32 (FIG. 1). The various disks 32 are moved in unison around centerline 38 to thus produce bodily movement of crankshaft 23 toward or away from combustion chamber 37. This action adjusts or varies the engine compression ratio.

FIG. 1 is taken with a representative disk 32 in an intermediate position of adjustment. In practice, the disk would take a position adjusted clockwise or counterclockwise from the illustrated position. In a typical engine configuration disk 32 rotation would be about ten degrees. Resultant motion of piston 19 would be on the order of 0.2 inch or less. Due to the angulation of each cam slot 55 (FIG. 2) the motion of rod 42 is much greater than 0.2 inch. With a 10/1 cam slope angle, the rod motion could be on the order of two inch. This is advantageous in that a rather precise adjustment of the piston 19 position is achieved without need for an exact movement of rod 42.

Figure 3:
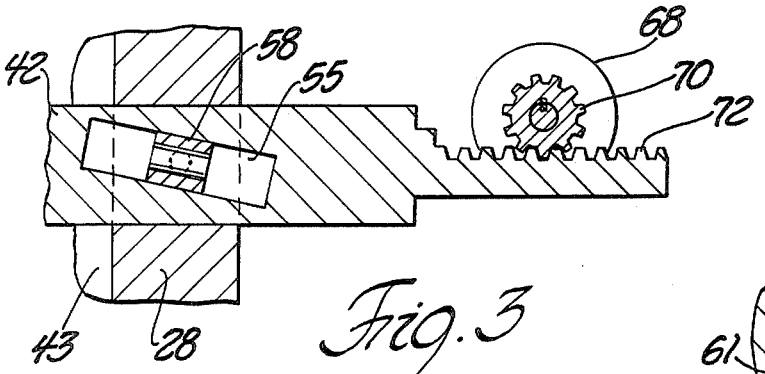
FIG. 3 is a view similar to FIG. 2, but illustrating an alternate type of operator for the depicted mechanism.

FIG. 3 illustrates an alternate form of operator for rod 42. In this case a Selsyn motor 68 has a pinion gear 70 meshed with a toothed rack 72 carried by rod 42. Electrical signals supplied to Selsyn motor 68 result in incremental motion of rod 42 and the associated shoes 58. With the FIG. 3 system, the various disks 32 can take intermediate positions (in addition to the two extreme positions). The FIG. 3 system therefore can provide a range of engine compression ratios rather than merely two ratios.

Figure 4:
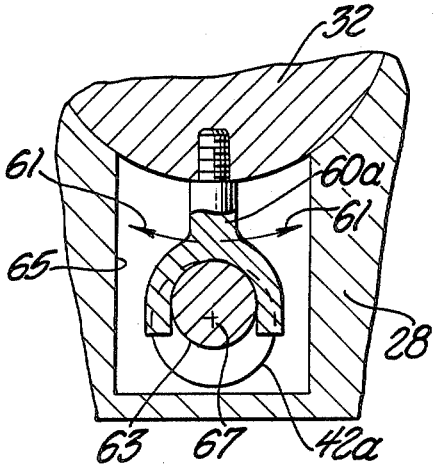
FIG. 4 is a fragmentary sectional view taken in the same direction as FIG. 1, but illustrating an alternate form of adjusting mechanism.

The operators shown in FIGS. 2 and 3 produce rectilinear slide motion of rod 42 in the direction of its length. FIG. 4 illustrates a somewhat different arrangement wherein the comparable motion is rotational in nature. FIG. 4 is taken in the same direction as FIG. 1. The various disks 32 would be constructed as shown in FIG. 1.

In the FIG. 4 arrangement each disk 32 is provided with an arm **60*a* extending into a pocket 65 in the associated wall 28. Arm 60*a* has a bifurcated outer end adapted to straddle a circular cam surface 63 formed on a circular shaft 42*a*. Shaft 42*a* is rotatably mounted in the various walls 28 for rotary motion around its central axis 67**.

A torque motor operator (not shown) is connected to the outer end of shaft **42*a* to rotate the shaft around axis 67. The eccentric location of cam surface 63 is such that shaft rotation produces arcuate swinging motion as designated by numerals 61. To accomplish the necessary swing action, shaft 42*a*** is required to move approximately one hundred eighty degrees (ninety degrees in each direction from the illustrated position).

Figure 5:
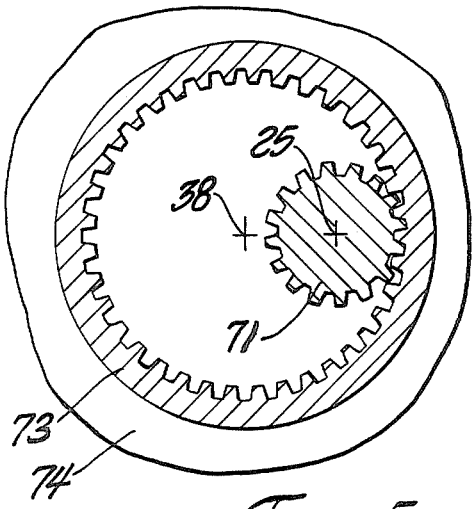
FIG. 5 is a sectional view taken through an output gear system driven by the FIG. 1 engine.

The above-described adjustments of disks 32 (FIGS. 1 through 4) cause the crankshaft axis 25 to be shifted up or down from its FIG. 1 position. If the output (drive) end of the crankshaft were rigidly connected to a flywheel the flywheel axis would have to undergo a similar adjustment; otherwise, the crankshaft-flywheel connection would destruct. FIG. 5 illustrates a crankshaft-flywheel connection that compensates for changes in the crankshaft rotational axis.

In this case, the drive end of the crankshaft carries a pinion gear 71 that meshes with internal teeth on an output ring gear 73. The ring gear may be affixed to, or integral with, a flywheel 74 (shown fragmentarily). The ring gear and pinion gear are oriented and sized so that the ring gear rotational axis coincides with centerline 38 for the various disks 30, and the rotational axis of the pinion gear coincides with the crankshaft axis 25. With such an arrangement adjusting motions of the various disks 32 around centerline 38 have no disturbing effect on ring gear 73 or the mesh connection between gears 71 and 73.

Figure 6:
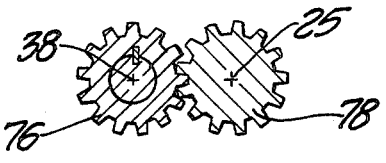
FIG. 6 is a sectional view taken through an alternate output gear system associated with the FIG. 1 engine.

FIG. 6 illustrates an alternate gear system that includes a first pinion gear 78 carried on the crankshaft and a second output pinion gear 76 carried on the flywheel (not shown). The axes for these two gears coincide with the aforementioned axes 25 and 38 for the crankshaft and disk 32.

The gear drive connections of FIG. 5 or FIG. 6 would be used at each end of the engine crankshaft. With either type of connection, adjustments in the location of the crankshaft centerline 25 do not disturb the gear mesh relationship (because of the orientation of the output gear centerline 38).

The construction shown in FIG. 1 is considered to be an improvement on the structures shown in U.S. Pat. No. 2,433,639 to Woodruff et.al. and U.S. Pat. No. 2,589,958 to Petit.

In Woodruff U.S. Pat. No. 2,433,639, the crankshaft is carried on a cradle 14 that is swingably supported on a support shaft 14-1. An arm **14*d* extends from the cradle outwardly through an opening in the side wall of the engine; a hydraulic cylinder means 24 interacts with arm 14*d* to raise or lower cradle 14** and the associated crankshaft.

My use of disks 32 is believed advantageous over Woodruff's cradle 14 in that I provide copious support surfaces 30 for the disks; which are close to the axis of the gas pressure loading, and are located in the main bearing bulkheads, which are designed to absorb the gas loading in any case. In Woodruff U.S. Pat. No. 2,433,639, load forces are applied through cradle 14 onto hydraulic cylinder means 24. I believe my arrangement will offer greater stability and load resistance than the arrangement proposed by Woodruff et.al. The elongated cradle 14 and arm structure **14*d* of Woodruff et.al. are susceptible to bending and fracture to a much greater extent than my disks 32**.

I also believe my system may be advantageous over Woodruff et.al. in that I achieve a desirable motion reduction between cam rod 42 (FIGS. 1 through 3) and the associated cam followers 58 (due to the angulation of each slot 55). The motion reduction permits precise adjustment of engine piston 19 without extreme tolerances on the operator structure 50 or 68. In Woodruff et al. tolerances on the position of shaft 14-1 and the crankshaft journals can produce undesired crankshaft deviations. Any bending of the cradle structure would also introduce a disturbing effect on crankshaft location.

In FIG. 3 of the Woodruff et. al. patent, there is shown a universal joint connection 65 between the crankshaft and driven shaft 63. The gear system shown in FIG. 5 or FIG. 6 of the instant drawings obviates the need for a universal joint of the type shown in the Woodruff et.al. patent. Additionally, my gear system achieves a speed change that is not possible with a universal joint.

The Woodruff et.al. arrangement also suffers in the sense that the width of the engine is considerably increased, compared to a standard engine of comparable size. My proposed arrangement increases the engine width dimension only to a minor extent.

My invention is also believed to be an advance over the Woodruff arrangement in that it employs electric or electro-hydraulic operators for achieving the desired engine compression ratio changes. Many proposed engines are programmed with microprocessor equipment that is supplied with engine performance feedback signals of electronic character; such signals represent operating variables such as inlet manifold pressure, engine coolant temperature, engine speed and barometric pressure. Selected ones of these electrical signals, or an electrical signal derived by the microprocessor, could be used to control the operator in my compression ratio mechanism. The hydraulic operators used by Woodruff do not have the sensitivity or versatility enjoyed by my contemplated operator mechanisms The aforementioned U.S. Pat. No. 2,589,958 to Petit is believed to be quite similar to Woodruff U.S. Pat. No. 2,433,639 in structure and function. My invention is believed to be an improvement over the Petit construction.

I wish it to be understood that I do not desire to be limited to the exact details of construction shown and described for obvious modifications will occur to a person skilled in the art, without departing from the spirit and scope of the appended claims.

What is claimed is:

1. In a four cycle engine that includes a crankshaft having a plural number of main shaft sections defining the crankshaft rotational axis and a plural number of crank arms defining orbital shaft sections, a plural number of combustion cylinders, a movable piston within each cylinder, each said cylinder and its associated piston defining a combustion chamber, a connecting rod connecting each piston to an orbital shaft section of the crankshaft, and a plural number of stationary support walls spaced along the crankshaft axis for absorbing crankshaft forces: the improvement comprising means for adjustably supporting the crankshaft on the stationary walls such that the crankshaft rotational axis is adjustable along the piston-cylinder axis for the purpose of varying a resulting engine compression ratio; said adjustable support means comprising a circular cavity in each stationary wall, a circular disk swivably seated in each cavity, each circular disk having a circular opening therethrough eccentric to the disk center; said crankshaft being arranged so that respective ones of its main shaft sections are located within respective ones of the circular openings; means for rotating each circular disk around its center so that the main shaft sections of the crankshaft are adjusted toward and away from the combustion chamber; a pinion gear on an output end of the crankshaft in axial alignment with and positioned beyond the respective ones of the main shaft sections, and a rotary output gear located about and engaged with teeth extending from the pinion gear; said output gear being mounted on an axis coincident with the common centers of the aforementioned disks, whereby adjusting motions of the disks around their centers have no disturbing effect on gear mesh action.

2. The improvement of claim 1 wherein the aforementioned stationary support walls constitute portions of an engine crankcase, the spaces between adjacent ones of the support walls defining an oil sump; said disk rotation means including an elongated rod oriented parallel to an imaginary centerline defined by the disk centers, said elongated rod passing between and through the stationary support walls in a location below the disk centerline.

3. The improvement of claim 1 wherein said pinion gear is a relatively small diameter pinion gear on the output end of the crankshaft, and the output gear is a relatively large diameter ring gear having internal teeth engaged with the teeth of the pinion gear; said ring gear being mounted on an axis coincident with the common centers of the aforementioned disks, whereby adjusting motions of the disks around their centers have no disturbing effect on the ring gear.

4. The improvement of claim 3 wherein the diameter of the ring gear is at least twice the diameter of the pinion gear, whereby the gear pair produces a substantial speed reduction.

5. The improvement of claim 1 wherein said disk rotation means comprises of cam-cam follower mechanism; said cam comprising an elongated rod oriented parallel to an imaginary centerline defined by the disk centers, said elongated rod being of sufficient length to extend between and through the aforementioned stationary support walls; said cam follower mechanism comprising cam follower elements extending radially outwardly from individual disks into operative engagement with the elongated rod.

6. The improvement of claim 5 wherein the elongated rod is mounted for longitudinal motion in the direction of its length.

7. The improvement of claim 5 wherein the elongated rod is mounted for rotary motion around its longitudinal axis.

8. The improvement of claim 5 wherein said disk rotation means further comprises an electro-hydraulic operator means connected to the elongated rod for moving same.

9. The improvement of claim 5 wherein said disk rotation means further comprises an electric power means connected to the elongated rod for moving same.

* * * * *